US011808532B2

(12) United States Patent
Kawano et al.

(10) Patent No.: US 11,808,532 B2
(45) Date of Patent: Nov. 7, 2023

(54) HIGHLY CORROSION-RESISTANT COPPER TUBE

(71) Applicant: NJT Copper Tube Corporation, Toyokawa (JP)

(72) Inventors: Kozo Kawano, Nagoya (JP); Shinobu Suzuki, Nagoya (JP)

(73) Assignee: NJT Copper Tube Corporation, Aichi (JP)

( * ) Notice: Subject to any disclaimer, the term of this patent is extended or adjusted under 35 U.S.C. 154(b) by 123 days.

(21) Appl. No.: 17/153,171

(22) Filed: Jan. 20, 2021

(65) Prior Publication Data

US 2021/0140727 A1 May 13, 2021

Related U.S. Application Data

(60) Continuation of application No. 16/129,209, filed on Sep. 12, 2018, now abandoned, which is a division of (Continued)

(30) Foreign Application Priority Data

Mar. 19, 2013 (JP) ..... 2013-055963

(51) Int. Cl.
*F28F 1/00* (2006.01)
*F28F 21/08* (2006.01)

(Continued)

(52) U.S. Cl.
CPC ..... *F28F 21/085* (2013.01); *C22C 9/00* (2013.01); *F28F 1/00* (2013.01); *F28F 19/00* (2013.01)

(58) Field of Classification Search
CPC . F28F 21/085; F28F 1/00; F28F 19/00; C22C 9/00

See application file for complete search history.

(56) References Cited

U.S. PATENT DOCUMENTS 2,224,095 A 12/1940 Barry
4,194,928 A 3/1980 Popplewell et al.

(Continued)

FOREIGN PATENT DOCUMENTS

CN 1730691 A 2/2006
CN 102978433 A 3/2013

(Continued)

OTHER PUBLICATIONS

International Search Report (Application No. PCT/JP2014/052418) dated Apr. 8, 2014.

(Continued)

*Primary Examiner* — Nael N Babaa
(74) *Attorney, Agent, or Firm* — Hamre, Schumann, Mueller & Larson, P.C.

(57) ABSTRACT

Use of a heat transfer tube in a damp environment in air-conditioning equipment and exposed to corrosive action caused by a corrosive medium comprising at least one lower carboxylic acid, the heat transfer tube a copper tube comprising 0.10-1.0% by weight of P and the balance consisting of Cu and inevitable impurities. The corrosive action progresses in the form of an ants' nest from an outer surface of the heat transfer tube in a direction of its wall thickness, wherein. Also, use of a copper tube comprising 0.10-1.0% by weight of P and the balance consisting of Cu and inevitable impurities for improving corrosion-resistance against ant nest corrosion caused by a corrosive medium consisting of a lower carboxylic acid in a damp environment, method of inhibiting ants' nest corrosion in a heat transfer tube, and a method of positioning a tube in an air conditioning apparatus or a refrigeration apparatus.

18 Claims, 3 Drawing Sheets

Related U.S. Application Data application No. 14/849,955, filed on Sep. 10, 2015, now abandoned, which is a continuation of application No. PCT/JP2014/052418, filed on Feb. 3, 2014.

(51) Int. Cl.
*F28F 19/00* (2006.01)
*C22C 9/00* (2006.01)

(56) References Cited

U.S. PATENT DOCUMENTS

| | | | |
|---|---|---|---|
| 4,337,793 | A | 7/1982 | Sato et al. |
| 6,202,703 | B1 | 3/2001 | Kuroda et al. |

FOREIGN PATENT DOCUMENTS

| | | | |
|---|---|---|---|
| JP | 61-221344 | A1 | 10/1986 |
| JP | 06-088177 | A1 | 3/1994 |
| JP | 06-122932 | A1 | 5/1994 |
| JP | H06-122932 | A | 5/1994 |
| JP | 2001-247923 | A1 | 9/2001 |
| JP | 2008-255380 | A | 10/2008 |
| JP | 2008-304170 | A1 | 12/2008 |
| JP | 2009-235428 | A1 | 10/2009 |
| JP | 2015-010265 | A | 1/2015 |

OTHER PUBLICATIONS

Japanese Office Action (Application No 2015-504804) dated Apr. 7, 2015 (with English translation).
Chinese Office Action (Application No. 201480016950.1) dated Jul. 8, 2016 (with English translation).
"Ido Hidekazu, Scale Adhesion-Resistant Heat Transfer Pipe for Heat Exchanger", 2008, Full Document (Year: 2008).
Kodaira Muneo, Corrosion Resistant High Strength Copper Tube, 1994, Full Document (Year: 1994).

HIGHLY CORROSION-RESISTANT COPPER TUBE

CROSS REFERENCE TO RELATED APPLICATIONS

This application is a continuation of U.S. application Ser. No. 16/129,209 filed on Sep. 12, 2018 (the benefit of which is claimed in this application), which is a divisional of U.S. application Ser. No. 14/849,955 filed on Sep. 10, 2015 (the benefit of which is claimed in this application), which is a continuation of the International Application No. PCT/JP2014/052418 filed on Feb. 3, 2014 (the benefit of which is claimed in this application), which claims the benefit under 35 U.S.C. § 119(a)-(d) of Japanese Application No. 2013-055963 filed on Mar. 19, 2013 (the benefit of which is claimed in this application), the entireties of which are incorporated herein by reference.

BACKGROUND OF THE INVENTION

Field of the Invention

The present invention relates to a highly corrosion-resistant copper tube, and more particularly relates to a copper tube suitably usable as a heat transfer tube and a refrigerant tube in air-conditioning equipment and refrigerating equipment, for example.

Description of Related Art

A tube made of a phosphorous deoxidized copper (JIS-H3300-C1220T) having excellent properties in terms of corrosion resistance, brazability, heat conductivity and bending workability, for example, has been mainly used as the heat transfer tube in the air-conditioning equipment, the refrigerant tube in the refrigerating equipment and the like.

However, it is recognized that the above-described phosphorous deoxidized copper tube used in the air-conditioning equipment and the refrigerating equipment suffers from generation of so-called "ant nest corrosion" (or "formicary corrosion") which is an unusual corrosion that progresses in the form of an ants' nest from the surface of the tube in a direction of its wall thickness. The ant nest corrosion is considered to be generated in a damp environment by a corrosive medium in the form of a lower carboxylic acid such as a formic acid and an acetic acid. Further, it is recognized that such corrosion is also generated in the presence of a chlorine-based organic solvent such as 1,1,1-trichloroethane, particular kinds of lubricating oil, and formaldehyde, for example. It is known that generation of the ant nest corrosion is particularly remarkable where the phosphorous deoxidized copper tube is used as a conduit in the air-conditioning equipment and the refrigerating equipment, which conduit is liable to dewing. Once the ant nest corrosion is generated, it progresses rapidly and penetrates through the wall of the copper tube in a short time, giving rise to a problem that the equipment becomes unworkable.

Under the above-described circumstances, JP-A-6-122932 proposes a corrosion-resistant high-strength copper tube, and discloses that resistance of the copper tube against the ant nest corrosion is improved since the copper tube contains 0.0025-0.01 wt % of phosphate (P) and the balance consisting of Cu and conventionally contained impurities, which copper tube may have an oxygen concentration not higher than 20 wtppm. Namely, based on the fact that generation of the ant nest corrosion is reduced in an oxygen-free copper tube having an extremely low P content, the P content of the copper tube proposed in the above-indicated publication is reduced as compared with that of the phosphorous deoxidized copper tube, so that the copper tube has a higher resistance against the ant nest corrosion than the phosphorous deoxidized copper tube.

However, the copper tube obtained by reducing the P content has not yet achieved a sufficiently high resistance against the ant nest corrosion which is comparable to that of the oxygen-free copper tube. Therefore, it is desired to develop a copper tube which can exhibit a higher resistance against the ant nest corrosion than the conventional copper tube, even in a severe corrosive environment.

SUMMARY OF THE INVENTION

The present invention was made in view of the background art described above. It is therefore an object of the invention to provide a copper tube which can exhibit a higher resistance against the ant nest corrosion, and which has an excellent anti-corrosion property and which is suitably usable in the air-conditioning equipment and the refrigerating equipment. Another object of the invention is to advantageously extend a service life of equipment produced by using such a copper tube.

The inventors of the present invention made intensive studies on the ant nest corrosion generated in the copper tube used in the air-conditioning equipment, the refrigerating equipment and the like, and found that the copper tube having a higher resistance against the ant nest corrosion can be practically and advantageously obtained by setting the P content of the copper tube to be higher than that of the conventional phosphorous deoxidized copper tube. The present invention was completed based on this finding.

Based on the above-described finding, the present invention provides a heat transfer tube used in a damp environment in air-conditioning equipment and exposed to a corrosive action caused by a corrosive medium consisting of a lower carboxylic acid, which corrosive action progresses in the form of an ants' nest from a surface of the heat transfer tube in a direction of its wall thickness, wherein the heat transfer tube is a highly corrosion-resistant copper tube having a high resistance against ant nest corrosion and comprising 0.10-1.0% by weight of P (phosphate) and the balance consisting of Cu and inevitable impurities. The present invention also provides a refrigerant tube used in a damp environment in refrigerating equipment and exposed to a corrosive action caused by a corrosive medium consisting of a lower carboxylic acid, which corrosive action progresses in the form of an ants' nest from a surface of the refrigerant tube in a direction of its wall thickness, wherein the refrigerant tube is a highly corrosion-resistant copper tube having a high resistance against ant nest corrosion and comprising 0.10-1.0% by weight of P and the balance consisting of Cu and inevitable impurities.

In the present invention, the P content of the highly corrosion-resistant copper tube is set within a range of 0.10-1.0% by weight, which P content is higher, by a predetermined amount, than that of the conventional phosphorous deoxidized copper tube, which is within a range of about 0.015-0.040% by weight. By using the above-described highly corrosion-resistant copper tube as the heat transfer tube for air-conditioning equipment and the refrigerant tube for refrigerating equipment, the resistance of the heat transfer tube against the ant nest corrosion and the resistance of the refrigerant tube against the ant nest corrosion are significantly improved. It is particularly surprising that the heat transfer tube and the refrigerant tube according to the present invention have a higher resistance against the ant nest corrosion than the conventional oxygen-free copper tube.

In a preferable form of each of the heat transfer tube for air-conditioning equipment and the refrigerant tube for refrigerating equipment according to the invention, each of the heat transfer tube and the refrigerant tube comprises not lower than 0.15% by weight of P.

In further preferable form of each of the heat transfer tube for air-conditioning equipment and the refrigerant tube for refrigerating equipment according to the invention, each of the heat transfer tube and the refrigerant tube comprises not higher than 0.8% by weight of P. In other preferable form of the heat transfer tube for air-conditioning equipment and the refrigerant tube for refrigerating equipment according to the invention, each of the heat transfer tube and the refrigerant tube comprises not higher than 0.5% by weight of P.

In still other preferable form of each of the heat transfer tube for air-conditioning equipment and the refrigerant tube for refrigerating equipment according to the invention, a total amount of the inevitable impurities is not higher than 0.05% by weight.

The present invention also provides a method for improving a corrosion resistance of a copper tube used in a damp environment in air-conditioning equipment or refrigerating equipment, against ant nest corrosion which is generated in the damp environment by a corrosive medium consisting of a lower carboxylic acid, and progresses from a surface of the copper tube, wherein the resistance of the copper tube against the ant nest corrosion is improved by forming the copper tube by using a material comprising 0.10-1.0% by weight of P and the balance consisting of Cu and inevitable impurities. In a preferable form of the method for improving the corrosion resistance of the copper tube according to the invention, the material of the copper tube comprises 0.3-1.0% by weight of P. In other preferable form of the method for improving the corrosion resistance of the copper tube according to the invention, a total amount of the inevitable impurities contained in the material of the copper tube is not higher than 0.05% by weight.

According to the present invention, the practical copper tube which is superior to the conventional copper tube in its anti-corrosion property in terms of the resistance against the ant nest corrosion can be provided. Further, by using the copper tube according to the present invention as the heat transfer tube in the air-conditioning equipment and the refrigerant tube in the refrigerating equipment, the service life of those equipment can be extended.

DETAILED DESCRIPTION OF THE INVENTION

Figure 1:
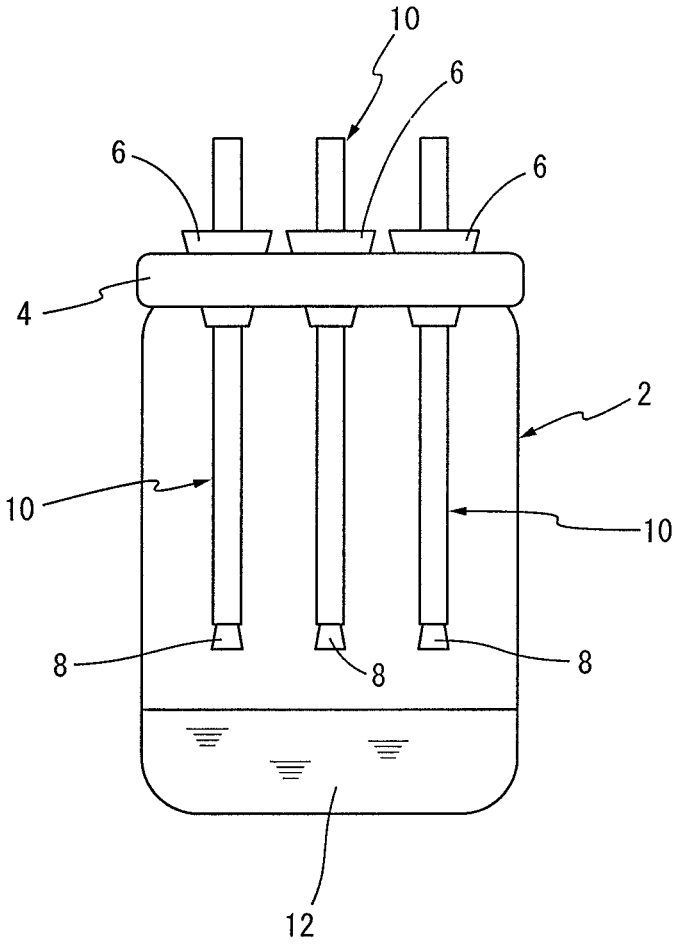
FIG. 1 is a schematic cross-sectional view showing an apparatus used for a corrosion resistance test in illustrated Examples.

A highly corrosion-resistant copper tube according to the invention has a major characteristic that its phosphate (P) content is held within a range of 0.05-1.0% by weight and higher than that of the conventional copper tube. It is considered that owing to such a high P content, the type of corrosion generated in the copper tube shifts from a selective corrosion which progresses in a direction perpendicular to the axial direction of the copper tube (i.e., in a direction of the wall thickness of the copper tube) to a surface corrosion which progresses in a direction parallel to the axial direction of the copper tube (i.e., in a direction extending along the surface of the copper tube). In particular, by setting the P content of the copper tube so as to be not lower than 0.10% by weight, and preferably not lower than 0.15% by weight, generation of the selective corrosion is effectively reduced or prevented, and the copper tube can exhibit corrosion resistance which is considerably higher than that of the conventional copper tube.

Where the P content of the copper tube is as low as 0.05% by weight, the selective corrosion is generated, but a rate of progress of the selective corrosion in the copper tube can be effectively reduced as compared with that in the conventional copper tube, so that the copper tube is recognized to have a higher resistance against the ant nest corrosion. Therefore, the P content of the copper tube is set so as to be not lower than 0.05% by weight, in the present invention. On the other hand, the upper limit of the P content of the copper tube needs to be set at 1.0% by weight, since the P content higher than 1.0% by weight causes almost no change in the resistance of the copper tube against the ant nest corrosion, and even causes deterioration of workability of the copper tube during its production, giving rise to a problem of cracking of the copper tube, for example. From the standpoint of practical production of the copper tube, the P content of the copper tube is preferably set so as to be not higher than 0.8% by weight, and more preferably not higher than 0.5% by weight.

The highly corrosion-resistant copper tube according to the present invention is made of a material having the P content described above with the balance consisting of Cu (copper) and inevitable impurities. A total amount of the inevitable impurities such as Fe, Pb and Sn contained in the copper tube is generally controlled so as to be not higher than 0.05% by weight.

The intended copper tube is produced by using a Cu material having the above-described composition according to the invention, by a method similar to the conventional method. For example, the copper tube is produced by steps of casting an ingot or a billet, and extruding and drawing the ingot or billet. Dimensions such as the outside diameter and the wall thickness of the thus obtained copper tube are adequately determined depending on the intended application of the copper tube. Where the copper tube according to the invention is to be used as a heat transfer tube, the copper tube may have a smooth internal surface, or may advantageously have various kinds of internal grooves formed in its internal surface by various known processes, as is well known in the art.

EXAMPLES

To clarify the present invention more specifically, some examples according to the present invention will be described. It is to be understood that the invention is by no means limited by the details of the illustrated examples, but may be embodied with various changes, modifications and improvements which are not described herein, and which may occur to those skilled in the art, without departing from the spirit of the invention.

Initially, various kinds of copper tube having compositions including respective P contents indicated in Table 1 given below, with the balance consisting of Cu and inevitable impurities were produced as in production of the conventional copper tube, such that each copper tube has an outside diameter of 9.52 mm and a wall thickness of 0.41 mm. The thus produced copper tubes were subjected to an ant nest corrosion test, as described below. Further, a Cu material containing 1.5% by weight of P and the balance consisting of Cu and inevitable impurities was used to produce a copper tube having dimensions similar to those of the above-described copper tubes, but the intended copper tube could not be obtained due to cracking of the tube. A phosphorous deoxidized copper tube and an oxygen-free copper tube each having the same dimensions as those of the above-described copper tubes were provided as comparative copper tubes.

TABLE 1

| Copper tube No. | Kind of copper tube | P content (% by weight) |
|---|---|---|
| 1 | Copper tube according to the invention | 0.11 |
| 2 | Copper tube according to the invention | 0.19 |
| 3 | Copper tube according to the invention | 0.30 |
| 4 | Copper tube according to the invention | 0.40 |
| 5 | Copper tube according to the invention | 0.50 |
| 6 | Copper tube according to the invention | 1.00 |
| 7 | Phosphorous deoxidized copper tube | 0.03 |
| 8 | Oxygen-free copper tube | <0.004 |

Each of the thus provided various kinds of copper tube was subjected to the ant nest corrosion test by using a test apparatus shown in FIG. 1. A plastic container 2 shown in FIG. 1 has a capacity of 2 L and can be hermetically sealed with a cap 4. Silicone plugs 6 are attached to the cap 4 such that the plugs 6 extend through the cap 4. Copper tubes 10 to be subjected to the corrosion test were inserted into the plastic container 2 by a predetermined length, such that the copper tubes 10 extend through the respective silicone plugs 6. Lower open ends of the copper tubes 10 were closed with silicone plugs 8. 100 mL of a formic acid aqueous solution having a predetermined concentration was accommodated in the plastic container 2, such that the copper tubes 10 do not contact with the aqueous solution.

The ant nest corrosion test was conducted by using three kinds of formic acid aqueous solutions 12 having respective concentrations of 0.01%, 0.1% and 1%. The copper tubes 10 were set with respect to each of the plastic containers 2 in which the respective formic acid aqueous solutions 12 were accommodated, and the plastic container 2 was left within a constant temperature bath at a temperature of 40° C. The plastic container 2 with the copper tubes 10 was taken out of the bath for two hours each day, and held at the room temperature (15° C.), to cause dewing on surfaces of the copper tubes 10 by the difference between the temperature of the constant temperature bath and the room temperature. The copper tubes 10 were subjected to the corrosion test under the above-described conditions for 20 days.

Each of the copper tubes subjected to the corrosion test using each of the formic acid aqueous solutions having the respective concentrations was examined in its cross section, and measured of its maximum corrosion depth. Results of the measurement are indicated in Table 2 given below. Further, a relationship between the maximum corrosion depth of the copper tubes subjected to the corrosion test using the 0.1% formic acid aqueous solution and the P content of the respective copper tubes is indicated in a graph of FIG. 2.

TABLE 2

| | Maximum corrosion depth (mm) | | |
|---|---|---|---|
| Copper tube No. | Formic acid concentration: 0.01% | Formic acid concentration: 0.1% | Formic acid concentration: 1% |
| 1 | 0.10 | 0.25 | — |
| 2 | 0.06 | 0.11 | 0.12 |
| 3 | 0.08 | 0.04 | 0.08 |
| 4 | 0.04 | 0.05 | 0.07 |
| 5 | 0.03 | 0.04 | 0.10 |
| 6 | <0.03 | 0.05 | — |
| 7 | 0.15 | 0.40 | >0.40 |
| 8 | 0.05 | 0.30 | >0.40 |

As is apparent from the results in Table 2, in the corrosion test conducted by using the formic acid aqueous solution having the concentration of 0.01%, the ant nest corrosion was not generated and only slight corrosion on the surfaces of the copper tubes was recognized in the copper tubes Nos. 1-6 having P contents within a range of 0.1-1.0% by weight, and the copper tube No. 8 which is the oxygen-free copper tube. On the other hand, in the corrosion test conducted by using the formic acid aqueous solutions having the respective concentrations of 0.1% and 1%, the ant nest corrosion was recognized in both of the copper tube No. 7 which is the phosphorous deoxidized copper tube, and the copper tube No. 8 which is the oxygen-free copper tube, and corrosion was recognized in the copper tubes Nos. 1-6 having the P contents within the range of 0.1-1.0% by weight. However, the corrosion generated in the copper tubes Nos. 1-6 was not the ant nest corrosion, and maximum corrosion depths of the copper tubes Nos. 1-6 are smaller than those of the phosphorous deoxidized copper tube and the oxygen-free copper tube.

Figure 2:
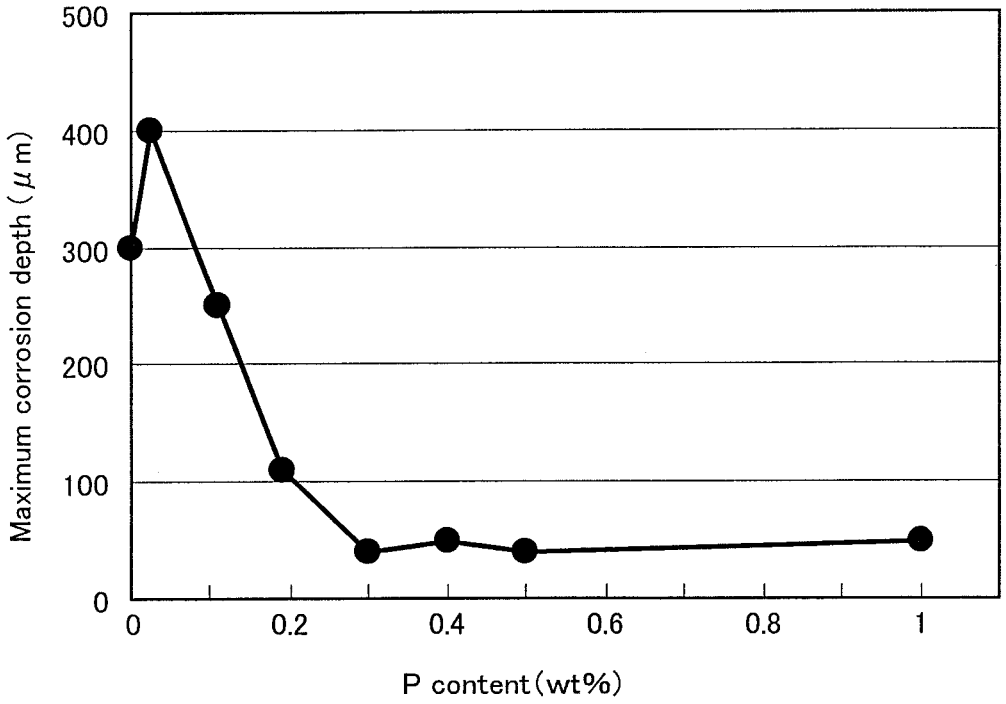
FIG. 2 is a graph showing a relationship between a P content of copper tubes obtained in the Examples and a maximum corrosion depth of those copper tubes.
Figure 3:
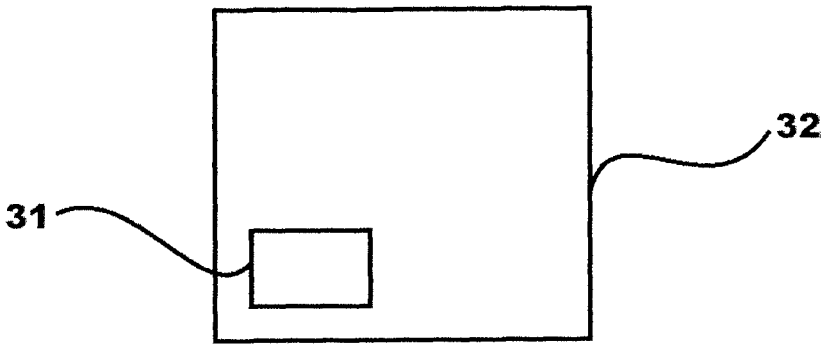
FIG. 3 is a schematic view showing a heat transfer tube 31 in air-conditioning equipment 32.
Figure 4:
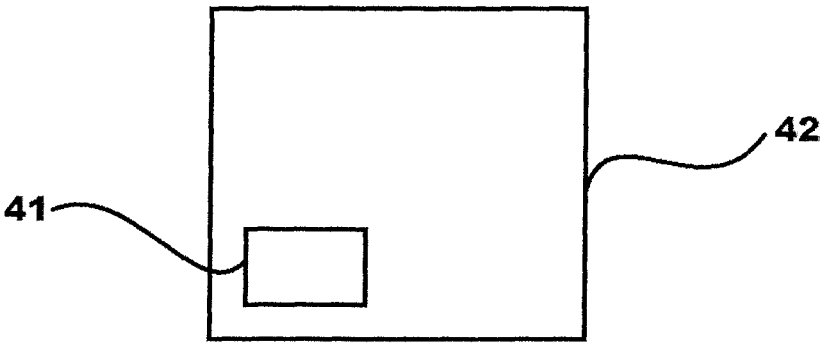
FIG. 4 is a schematic view showing a heat transfer tube 41 in a refrigeration apparatus 42.

Further, as indicated in FIG. 2, the copper tubes having P contents higher or lower than the P content of 0.03% by weight of the phosphorous deoxidized copper tube (No. 7) have smaller maximum corrosion depths than the phosphorous deoxidized copper tube (No. 7). It is particularly noted that the copper tubes (Nos. 1-6) according to the present invention having higher P contents than the phosphorous deoxidized copper tube (No. 7) are superior to the oxygen-free copper tube (No. 8) in their maximum corrosion depths.

The invention claimed is:

1. A method for suppressing ants' nest corrosion, comprising:

producing a heat transfer tube, wherein the heat transfer tube consists of copper, phosphorous, and inevitable impurities comprising at least one of Fe, Pb, and Sn, the inevitable impurities being contained in an amount of not higher than 0.05% by weight in total, and the producing of the heat transfer tube includes adding the phosphorous so as to be 0.19-1.0% by weight in total to suppress the ants' nest corrosion, positioning the heat transfer tube in air-conditioning equipment and operating the air-conditioning equipment, whereby the heat transfer tube is exposed to a corrosive action caused by a corrosive medium comprising at least one lower carboxylic acid, in which said corrosive action progresses in the form of said ants' nest corrosion from an outer surface of the heat transfer tube in a direction of its wall thickness.

2. The method as recited in claim 1, wherein the heat transfer tube contains not lower than 0.8% by weight of the phosphorous.

3. The method as recited in claim 1, wherein the heat transfer tube contains not lower than 0.5% by weight of the phosphorous.

4. The method as recited in claim 1, wherein the heat transfer tube contains not lower than 0.3-1.0% by weight of the phosphorous.

5. The method as recited in claim 1, wherein the operating of said air conditioning equipment is such that heat is transferred through said heat transfer tube.

6. The method as recited in claim 1, wherein the corrosion progresses in a direction extending along a surface of the heat transfer tube.

7. The method as recited in claim 1, wherein the producing of the heat transfer tube includes casting an ingot or a billet, and extruding and drawing the ingot or the billet.

8. The method as recited in claim 1, wherein the heat transfer tube contains 0.40% by weight of the phosphorous.

9. The method as recited in claim 1, wherein the heat transfer tube contains 1.00% by weight of the phosphorous.

10. A method for suppressing ants' nest corrosion comprising subjecting a copper tube having a composition consisting of copper, 0.19-1.0% by weight of phosphorous, and inevitable impurities comprising at least one of Fe, Pb and Sn, to a corrosive medium comprising a lower carboxylic acid, the inevitable impurities being contained in an amount of not higher than 0.05% by weight in total, said composition of the copper tube providing corrosion-resistance against ants' nest corrosion caused by said corrosive medium.

11. The method as recited in claim 10, wherein the heat transfer tube contains not lower than 0.8% by weight of the phosphorous.

12. The method as recited in claim 10, wherein the heat transfer tube contains not lower than 0.5% by weight of the phosphorous.

13. The method as recited in claim 10, wherein the heat transfer tube contains not lower than 0.3-1.0% by weight of the phosphorous.

14. The method as recited in claim 10, further comprising positioning the heat transfer tube in air conditioning equipment and operating said air conditioning equipment such that heat is transferred through said heat transfer tube.

15. The method as recited in claim 10, wherein corrosion progresses in a direction extending along a surface of the heat transfer tube.

16. The method as recited in claim 10, wherein the heat transfer tube was produced by casting an ingot or a billet, and extruding and drawing the ingot or the billet.

17. A method of inhibiting ants' nest corrosion in a heat transfer tube, the method comprising:

forming a tube having a composition consisting of copper, 0.19-1.0% by weight of phosphorous, and inevitable impurities comprising at least one of Fe, Pb and Sn, the inevitable impurities being contained in an amount of not higher than 0.05% by weight in total;

positioning the tube in an air conditioning apparatus or a refrigeration apparatus; and subjecting the tube to a corrosive environment comprising at least one lower carboxylic acid.

18. A method, comprising:

forming a heat transfer tube, wherein the heat transfer tube consists of copper, phosphorous, and inevitable impurities comprising at least one of Fe, Pb, and Sn, the inevitable impurities being contained in an amount of not higher than 0.05% by weight in total, and the producing of said heat transfer tube includes adding the phosphorous so as to be 0.19-1.0% by weight in total to suppress ants' nest corrosion, positioning said heat transfer tube in an air conditioning apparatus or a refrigeration apparatus;

operating said air conditioning apparatus or refrigeration apparatus such that heat is transferred through said tube; and exposing said tube to a corrosive medium in said air-conditioning apparatus or said refrigeration apparatus, in which said corrosive medium generates ants' nest corrosion that progresses from a surface of said tube.

* * * * *